US008690480B2

(12) United States Patent
Roveri et al.

(10) Patent No.: US 8,690,480 B2
(45) **Date of Patent: *Apr. 8, 2014**

(54) FREESTANDING HYBRID RISER SYSTEM

(75) Inventors: Francisco Edward Roveri, Rio de Janeiro (BR); Jose Mauricio Teixeira da Gama Lima, Rio de Janeiro (BR)

(73) Assignee: Petroleo Brasileiro S.A.—PETROBRAS, Rio de Janeiro, RJ (BR)

( * ) Notice: Subject to any disclaimer, the term of this patent is extended or adjusted under 35 U.S.C. 154(b) by 0 days.

This patent is subject to a terminal disclaimer.

(21) Appl. No.: 13/609,967

(22) Filed: Sep. 11, 2012

(65) Prior Publication Data

US 2013/0022406 A1 Jan. 24, 2013

Related U.S. Application Data

(63) Continuation of application No. 12/648,510, filed on Dec. 29, 2009, now Pat. No. 8,262,319.

(30) Foreign Application Priority Data

Dec. 29, 2008 (BR) ..... 0805633

(51) Int. Cl.
*E02D 5/74* (2006.01)
*F16L 1/16* (2006.01)

(52) U.S. Cl.
USPC ..... 405/166; 405/224

(58) Field of Classification Search
USPC ..... 405/166, 224, 158, 195.1, 224.1, 169; 166/367
See application file for complete search history.

(56) References Cited

U.S. PATENT DOCUMENTS

| | | | | |
|---|---|---|---|---|
| 5,007,482 | A * | 4/1991 | Forsyth et al. | 166/345 |
| 6,837,311 | B1 | 1/2005 | Sele et al. | |
| 2004/0031614 | A1 | 2/2004 | Kleinhans | |
| 2004/0074649 | A1 | 4/2004 | Hatton et al. | |
| 2004/0156684 | A1 | 8/2004 | Pionetti | |
| 2004/0218981 | A1 | 11/2004 | Chenin | |
| 2006/0065401 | A1 | 3/2006 | Allen | |
| 2007/0044972 | A1 | 3/2007 | Roveri et al. | |
| 2008/0223583 | A1 | 9/2008 | Roveri et al. | |
| 2010/0018717 | A1 | 1/2010 | Espinasse et al. | |

FOREIGN PATENT DOCUMENTS

BR PI 0505400-1 9/2007

(Continued)

OTHER PUBLICATIONS

Vieira et al., "Studies on VIV Fatigue Behavior in SCRS of Hybrid Riser Systems", Proceedings of OMAE '02, Jun. 23-28, 2002, pp. 33-39.

Roveri et al., "Free Standing Hybrid Riser for 1800 M Water Depth", Proceedings of OMAE '05, Jun. 12-17, 2005, pp. 1-11.

Pereira et al., "Experimental Study on a Self Standing Hybrid Riser System Throughout Tests on a Deep-Sea Model Basin", Proceedings of OMAE '05, Jun. 12-17, 2005, pp. 1-7.

(Continued)

*Primary Examiner* — David Bagnell
*Assistant Examiner* — Kyle Armstrong
(74) *Attorney, Agent, or Firm* — Nixon & Vanderhye P.C.

(57) ABSTRACT

A freestanding hybrid riser system (FHRS) and a method of installation which makes it possible to use vessels that are more available on the world market. The invention relates to a top riser assembly (TRA) having multiple, offset connection points such that a first bending moment is applied to the TRA by a buoyant unit, and an opposing bending moment is applied to the TRA by a flexible jumper.

12 Claims, 12 Drawing Sheets

(56) References Cited

FOREIGN PATENT DOCUMENTS

| | | |
|---|---|---|
| BR | PI 0600219-6 | 10/2007 |
| EP | 1 849 701 | 10/2007 |
| FR | 0700549 | 1/2007 |
| WO | WO 2005/001235 | 1/2005 |
| WO | 2007108673 | 9/2007 |

OTHER PUBLICATIONS da Costa et al., "Evaluation of Service Life Reduction on a Top Tensioned Vertical Riser Due to Vortex Induced Vibration", Proceedings of the XXVI Iberian Latin-American Congress, Oct. 19-21, 2005, 12 pages.

* cited by examiner

FREESTANDING HYBRID RISER SYSTEM

CROSS RELATED APPLICATION

This application is a continuation of application Ser. No. 12/648,510 filed Dec. 29, 2009 (now U.S. Pat. No. 8,262,319) the entirety of which application is incorporated by reference.

SCOPE OF THE INVENTION

This invention relates to an improved freestanding hybrid riser system (FHRS) and a method for installing it in which structural and functional improvements for some of the components in the system in comparison with some configurations already installed by the industry are proposed.

Depending on the dynamic structural response of the FHRS, a method of installation which makes it possible to use vessels that are more available on the world market is also proposed.

BASIS OF THE INVENTION

A freestanding hybrid riser (FHRS) comprises a vertical steel section supported at its top end by a floating tank, the pull from which provides the system with stability. The floating tank is at a depth at which the effects of surface currents and waves are significantly attenuated. A length of pipe or flexible riser in a double catenary connects the end of the vertical section to the production platform. The link between the floating tank and the top end of the vertical section of the riser is provided by a tie bar or mooring connection. The base for the riser, which may be a suction pile or a drilled steel pipe grouted to the sea bed is located at its bottom end.

The FHRS may be used in systems for the production (gathering) or export of oil or gas. The fluids produced or exported pass through a single riser line known as the "riser monobore", which also performs the structural function of supporting the system. At its bottom end it has a component which makes the connection between the vertical section and the gathering or export line, which is a length of pipe located at the base of the riser and made of steel, known as a rigid jumper.

This invention provides an FHRS system which has been improved through structural and functional improvements to some components of the system in comparison with some configurations already installed by the industry and, depending on the dynamic structural response of the proposed FHRS, a method of installation which uses two types of vessels that are more available on the market, offering technical and operational benefits.

RELATED TECHNOLOGY

In offshore production systems oil produced from wells located on the sea bed is transported to a production unit through pipes which may be rigid, flexible or even a combination of both. These pipes are known to those skilled in the art as risers, and may provide a connection between the floating unit and the sea bed.

Risers may be flexible or rigid, or even a combination of both types, and are responsible for a considerable part of the total costs of production oilfields, these costs being related to the costs of manufacture, installation and maintenance, for example.

In general, as operational loads are involved, undersea pipes have to be designed to satisfy functional requirements due to loads corresponding to the internal medium (the fluid being transported), the external medium, various environmental loads from waves and currents, and movements of the floating unit during the useful design life. The installation stage is also a critical stage as regards riser design. In addition to the combined flexing and external pressure load, in the course of installation the pipe is subjected to the axial pull exerted by the launching vessel to prevent premature buckling (collapse) of the line caused by excessive curvature. The state of tension produced by this loading condition must be maintained with suitable safety factors, below the corresponding limiting strength of the pipe.

Anchored floating units, such as semi-submersible platforms, although stable, cannot avoid being affected by their environment. Examples of these movements include movements induced by surface waves, or winds or currents in the sea itself. Strong maritime currents occur in deep water areas. A strong maritime current can give rise to vibrations induced by vortices which increase the rate of fatigue of the material, causing cumulative damage to the pipes.

The above movements affect the connections between the risers and the platform and in more serious cases affect the structure of the riser itself, which may undergo structural buckling. The problem is more severe for rigid risers, where the stress is more aggressive. Flexible risers minimize this stress, partly transferring it to the strength of the flexible materials.

Risers may be classified according to their configuration, material and purpose. On the basis of their configurations we can classify them as vertical, catenary or complex (using floats):

a) Vertical risers: a pulling force is applied to the top in order to keep the riser under tension at all times, preventing buckling. This configuration requires the use of platforms with a low dynamic response.

b) Catenary risers: in most cases no pulling force is applied to the top. The ends (the top and bottom of the riser) are not in the same alignment.

c) Complex risers: derived from the catenary configuration, the risers have a geometry in the form of a double catenary through the fitting of floats or buoys which are held submerged by anchors.

Rigid pipes are widely used in subsea installations because of their structural simplicity and their greater resistance to collapse at great depths, unlike flexible pipes. They are generally complex multilayer structures of polymers and metal alloys, each having a different functional and structural purpose.

Although they have some advantages, flexible pipes have limited strength because present technologies limit installations to depths of approximately 2500 meters. Nevertheless, the process of installing a flexible pipe is faster and requires less engineering time.

At the present time oil discoveries at great depths offshore have led to the development of fields located at depths of approximately 3000 meters, so the freestanding hybrid riser system (FHRS) is an attractive alternative. The FHRS is based on a vertical rigid pipe which is slightly shorter than the local depth and is a more robust and durable alternative than the conventional configuration which uses a flexible riser.

The greater the water depth (WD), the greater the force imposed on the export riser. Apart from weight, which increases tensions in the structure, the riser may also be subject to vibration through the action of currents. Risers may not show any deformation, but over their useful lives these cyclical tensions can result in fatigue and failure. As progress is made into deeper waters, riser designs become more complex and varied.

The design of a rigid pipe requires many hours of engineering work, because the greater stiffness gives rise to a number of difficulties in installation and operation. This characteristic reduces the ease with which the pipe can be attached to the sea bed. Another problem relates to their shape, because pipes are stored onshore and transported to the place where they are installed. Rolling them up is not as simple as in the case of flexible pipes. At the same time larger structures have to be used in order to fit them. There are other methods where the pipe is installed on the high seas.

At the present time production systems use dynamic positioning drilling vessels provided with a tower and a riser comprising threaded joints of drill pipe. The stability of the riser is provided by the pulling force applied to its top through a tensioning device on the vessel, located beneath its tower. This production system is characterised by high operating costs, because it uses a vessel which is not widely available on the world market.

Vessels of the PLSV or Pipelay Support Vessel type provide services in connection with the installation of undersea pipelines. There are various models of vessel available, each with its equipment layout depending on the type of service provided. These vessels are capable of laying kilometers of pipe, which may be rigid pipe or flexible pipe, or even both, depending upon the scope of the work which has to be done, after loading only once.

Some items of equipment are always present in the construction of vessels of this type, such as: reels, tensioners, cranes and winches.

A vessel of the PLSV type, like the Seven Oceans vessel, the main activity of which is the laying of rigid pipe, can be used to conduct secondary activities such as, for example, the installation of undersea equipment.

One of the quickest ways of installing rigid pipes is through vessels which use the Reel Method. In this method long pipes are rolled onto a large diameter reel. The vessel is loaded at a port base where the sections required for the project have already been manufactured. When the reel is full the vessel departs to the point of installation and starts gradually unrolling the pipe.

With technological progress many types of riser configuration have been developed with the aim of making oil production from offshore fields viable. Of the various types of configuration there are those which use rigid risers, such as for example top tensioned risers (TTR), steel catenary risers (SCR) and hybrid configurations comprising rigid riser parts and flexible riser parts.

The paper "Evaluation of service life reduction of a top tensioned vertical riser due to vortex induced vibration" presented at the XXVI Iberian Latin-American Congress in Computational Methods in Engineering, 2005, by Morooka et al., analysed the dynamic behaviour of a structure of the TTR type and its useful life due to fatigue.

Vieira et al., in the paper "Studies on VIV Fatigue Behaviour in SCRs of Hybrid Riser Systems" presented at the 21.sup.st International Conference on Offshore Mechanics and Arctic Engineering, 2002, Roveri et al., in the paper "Free Standing Hybrid Riser for 1800 m Water Depth" presented at the 24.sup.th International Conference on Offshore Mechanics and Arctic Engineering, 2005, and Pereira et al., in the paper "Experimental Study on a Self-Standing Hybrid Riser System Throughout Test on a Deep Sea Model Basin" presented at the 24.sup.th International Conference on Offshore Mechanics and Arctic Engineering, 2005, discuss the benefits of using a hybrid configuration system. Basically these systems comprise flexible risers at the top of the system and rigid risers at the bottom. These rigid risers may have a vertical or catenary configuration. One of the greater advantages of this type of configuration is that forces due to dynamic movements of the floating unit on the rigid riser are attenuated, thus attempting to minimise failure due to fatigue. In particular, a freestanding hybrid riser (FHRS) comprising a vertical rigid riser supported by a subsurface buoy connected to a floating unit through a flexible pipe or jumper is a configuration which has been proven for application in ultra-deep waters.

Initiatives of this kind have given rise to designs which are finding increasing use in various applications, such as US Patent Application 2008/0223583 A1 corresponding to Brazilian Patent Application PI 0401727-7 which describes a freestanding riser system for a long term test in offshore oil production using an immersed Christmas tree (ICT) connected to a wellhead and a floating production unit (FPU). The said system comprises a well head on the sea bed connected to an ICT provided with a preventer, connected to a production riser through a connection fitting. The riser, which is internally connected to a set of buoys, is held under tension with the help of this set of buoys. The top end of the riser is provided with an undersea working terminal, this terminal being connected to an FPU through a flexible jumper to carry the oil produced to the FPU.

U.S. Pat. No. 6,837,311 describes a hybrid riser configuration comprising a plurality of steel risers, substantially inserted in aluminium pipes, with floating and tensioning means, in which the pipes and risers are rigidly connected to a base anchored on the sea bed.

Patent Application EP1849701 A1 relates to a disconnectable anchoring system comprising a vessel with a support which supports the riser, which is provided with a piece at the top of the riser which is joined to the support by means of disconnectable bolts.

Application WO2005/001235 A1 discloses an offshore well riser system comprising one or more tubular pipes suspended from a floating platform and incorporating extended bottom ends of inclined shape vertically attached to the sea bed. A bottom connection is provided at the end of the pipes and comprises a jumper for connecting the bottom end of each pipe to an associated undersea well, a weight to apply a vertical tension to the pipes and equipment to restrict horizontal movements of the ends of the pipes.

PI 0505400-1 A describes an articulated support for a riser whose main function is to provide a connection to a floating unit, the top of a riser from a well on the sea bed, or another platform, or even leading onshore, which may be rigid, flexible or comprise a combination of the latter, this having a catenary or other more complex configuration.

PI 0600219-6 A discloses a system designed to compensate for vertical movement of the suspension point for risers laid in a catenary configuration caused by the natural movement present in offshore vessels. The objective is accomplished through the design of a system which according to the invention comprises a compensator for hydropneumatic movements which supports the riser in a catenary configuration down to the sea bed and a flexible riser segment connected to the production facilities of a stationary production unit (SUP).

SUMMARY OF THE INVENTION

This invention describes an improved freestanding hybrid riser system (FHRS) and a method for installing it in which new configurations of some components at the interfaces of the top and bottom ends of the vertical section of the riser, in comparison with some configurations already installed by the industry, are proposed. Depending on the dynamic structural response of the FHRS system described, a method for installing the system which makes it possible to use two types of vessels which are more available on the world market and thus gives rise to technical and operational improvements is also proposed.

DETAILED DESCRIPTION OF THE INVENTION

The proposal in the application for an invention describes an improved freestanding hybrid riser system (FHRS) which has new configurations for the components at the top (3) and bottom (5) end interfaces of the vertical section of the riser (1) and proposes a method of installation depending on the dynamic structural response of the FHRS system which makes it possible to use two types of vessels which are more available on the world market.

Figure 1:
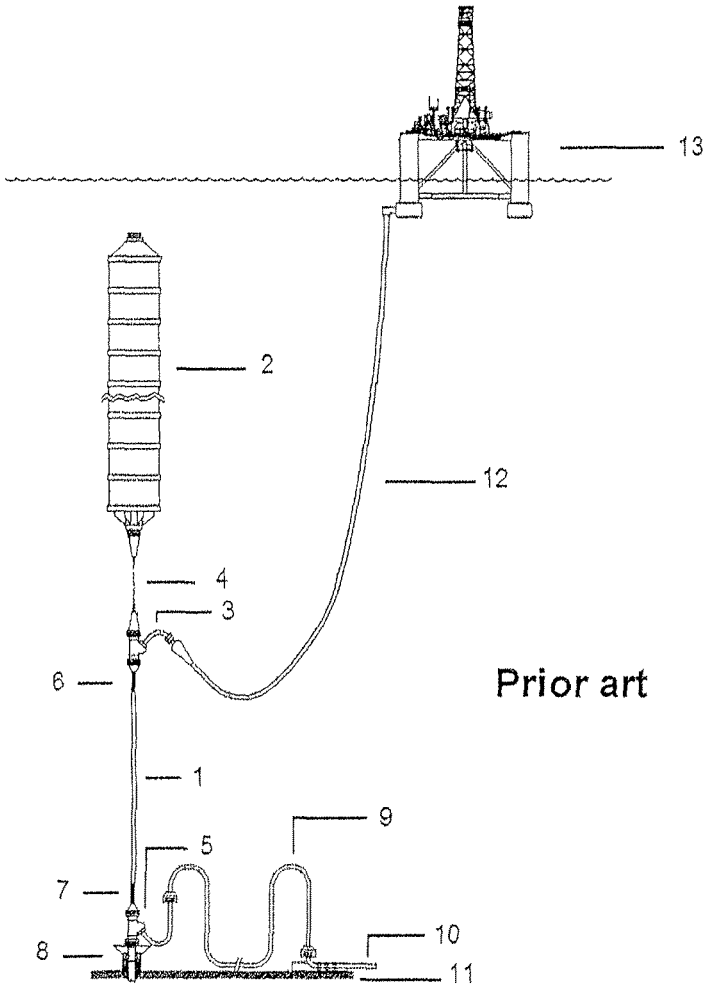
FIG. 1 shows a diagram of a freestanding hybrid riser (FHRS) according to the state of the art.

FIG. 1 illustrates the state of the art for a hybrid configuration system in a water depth (WD) of approximately 1100 meters which comprises a vertical section of riser (1) drawn up by a floating tank (2) at its top end (3), the pull of which provides stability for the system. The connection between floating tank (2) and top end (3) of riser (1) is provided by a tie bar (4). Upper (6) and lower (7) strengthening joints are connected to the top (3) and bottom (5) ends of riser (1). A base (8) for riser (1) is located at the bottom end (5) thereof, and this may be a suction pile or a drilled steel pipe grouted to the sea bed. At the bottom end (5) of riser (1) a component known as a rigid jumper (9), made of steel, provides the connection between the vertical section of riser (1) and the gathering or export line (10) on the sea bed (11). A length of flexible jumper (12), made of various layers of polymer and metal material, connects the end of riser (1) to floating production unit—FPU (13).

Figure 2:
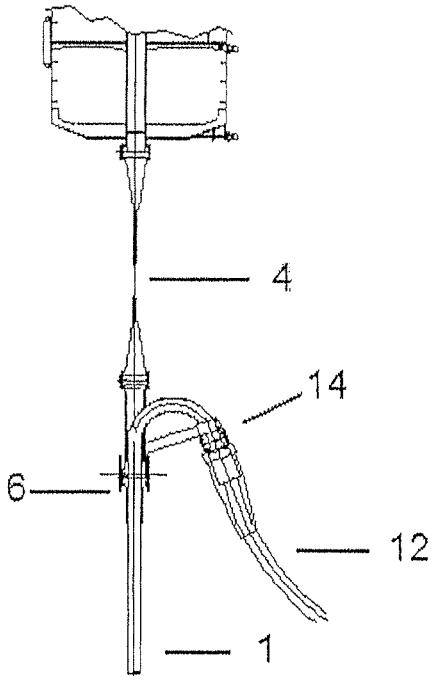
Prior art Figure 2
FIG. 2 illustrates interface details at the top end of an FHRS according to the state of the art.
Figure 3:
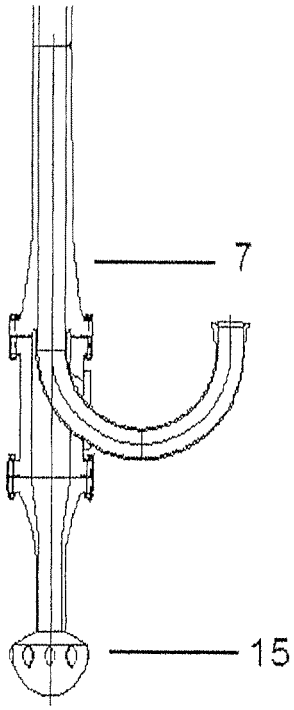
Prior art Figure 3
FIG. 3 illustrates details of the interface at the bottom end of an FHRS according to the state of the art.

FIGS. 2 and 3 illustrate details of the interface at the top end (3) of the FHRS which has a flange (14) connecting upper strengthening joint (6) to flexible jumper (12) and a bottom end (5) of the FHRS which includes a Rotolach connector (15) connected to base (8).

The first part of this invention relates to structural and functional improvement of some of the components of the freestanding hybrid riser system (FHRS), while the second part describes a process for installation of the improved FHRS using the Reel Method.

With regard to the improvement in the components, modifications (a), (b) and (c) described below are proposed:

a) The interface between flexible jumper (12) and the vertical section of riser (1) illustrated in FIG. 2 requires both to be installed together. This gives rise to a problem if flexible jumper (12) has to be replaced for maintenance. Considering the geometry of the components, disconnection of flange (14) at the interface between flexible jumper (12) and the top end (3) of riser (1) could require teams of divers and specialist equipment for carrying out the task, thus giving rise to significant technical and economic questions relating to this maintenance operation.

Figure 4:
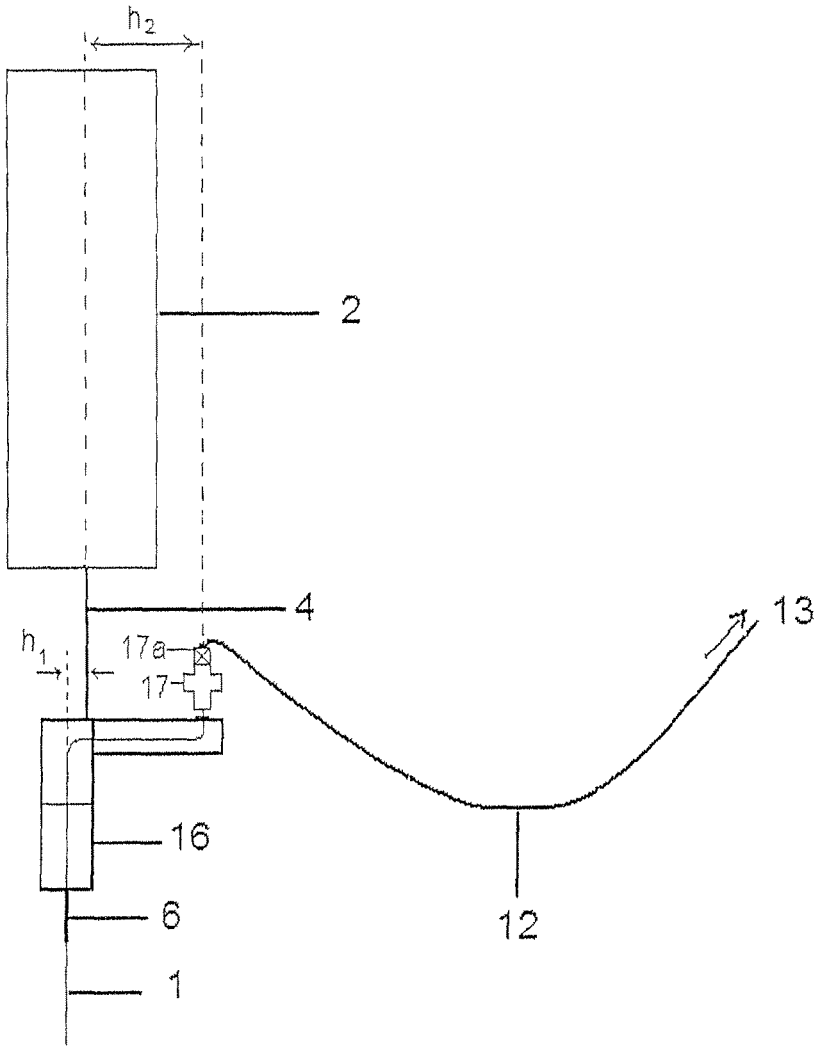
FIG. 4 illustrates the new interface at the top end of the vertical section of the riser with a flexible jumper.

Thus FIG. 4 illustrates a new configuration for the top end (3) of riser (1), containing the top riser assembly (TRA) component (16) which has a tubular structure in the form of a spatial portal having the following functions:

- provision of a path for the pulling load from floating tank (2) to the vertical section of riser (1),
- provision of support for the curved section of riser (1), [0061] provision of support for the top end (3) of riser (1) where
- a vertical connection module (17) located at the end of flexible jumper (12) will be attached.

Figure 5:
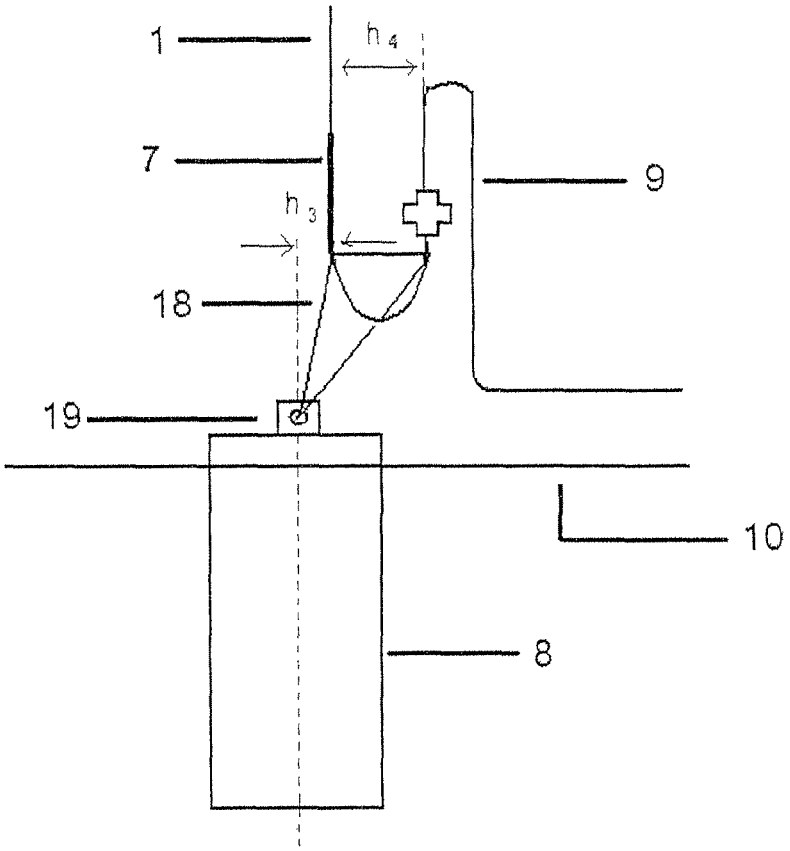
FIG. 5 illustrates an interface according to the state of the art at the bottom end of the vertical section of the riser with the base and a rigid jumper.

The new configuration has the following differences in comparison with the state of the art:

- the fitting to which the vertical connection module (17) at the end of flexible jumper (12) is connected is located beyond the limits of the horizontal projection of floating tank (2) (distance $h_2$ in FIG. 4) making it possible for flexible jumper (12) to be installed after the vertical section of riser (1) has been installed. In addition to this, this configuration means that, if maintenance of flexible jumper (12) requires its removal, disconnection at 17(*a*) of vertical connection module (17) can be carried out remotely by submarine robots (ROV), without the need for divers.

b) The pull applied by floating tank (2) is transmitted to TRA (16) at a point located at a horizontal distance $h_1$ from the vertical axis of upper strengthening joint (6), while the vertical force exerted by flexible jumper (12) is applied at a horizontal distance ($h_1$+$h_2$) from this axis, as shown in FIG. 4. $h_1$ is the horizontal distance between the principal axis of tie bar (4) and the vertical section of riser (1) and $h_2$ is the horizontal distance between the principal axis of tie bar (4) and the end of the vertical connection module attached to TRA (16). These distances depend on design variables such as the water depth (WD) and the dimensions of the components of the system. These configurations have the effect that the forces applied to TRA (16) by floating tank (2) and flexible jumper (12), in opposite directions, result in bending moments of different signs at upper strengthening joint (6), which results in a decrease in the static loads acting upon it.

c) The interfaces between the bottom end of riser (1) and base (8) and rigid jumper (9), illustrated in FIG. 5, mean that, as in the case of TRA (16), there is compensation between the static forces acting at lower strengthening joint (7). The vertical reaction force at the interface between riser (1) and base (8) is transmitted to Bottom Riser Assembly (BRA) (18) at a point located at a horizontal distance $h_3$ from the vertical axis of upper strengthening joint (6), while the vertical force exerted by rigid jumper (9) is applied at a horizontal distance $h_4$ from that axis, as shown in FIG. 5. $h_3$ is the distance between the vertical axis of base (8) and the vertical section of riser (1) and $h_4$ is the distance between the vertical section of riser (1) and the interface between BRA (18) and rigid jumper (9). These distances depend on design variables such as the water depth (WD) and the dimensions of the components of the system. These configurations have the result that the forces applied to BRA (18) by base (8) and by rigid jumper (9) result in bending moments having different signs at lower strengthening joint (7), which brings about a reduction in the acting static loads.

In the state of the art the interface between riser (1) and base (8) is provided through a mechanical connector having a flexjoint (19) and lower strengthening joint (7) is positioned a few meters above flexjoint (19). The geometry of this configuration has the result that movements and loads originating in riser (1) are almost wholly transmitted to rigid jumper (9).

Figure 6:
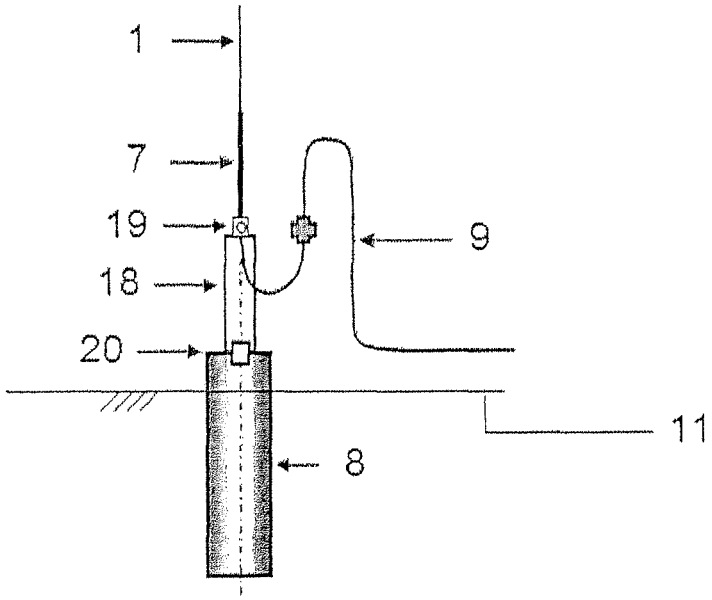
FIG. 6 illustrates the new interface between the bottom strengthening joint and the bottom end component of the riser or Bottom Riser Assembly (BRA) comprising a flexible element or flexjoint, made up of layers of steel and elastomer.

FIG. 6 illustrates a new configuration in which there is a flexible element or flexjoint (19) at the base of lower strengthening joint (7). This flexjoint (19) comprises interleaved layers of steel and elastomer and significantly attenuates the bending moment transmitted by lower strengthening joint (7) to the structure of BRA (18) and rigid jumper (9), given that it acts as a filter for the bending forces arising. In this way rigid jumper (9) is less susceptible to dynamic loads originating from the vertical section of riser (1). In this case there is a rigid connection (20) between BRA (18) and base (8).

The process for installing the proposed FHRS using the Reel Method is described below. The hybrid risers mentioned as examples of the state of the art are installed by the J-Lay Method. In this method pipes approximately 50 meters long (quad joints) are welded in the vessel's tower during installation, as the riser enters the water. The Reel Method is faster, because all the welds except the welds for the end standard joints at the two strengthening joints are made onshore.

Figure 7:
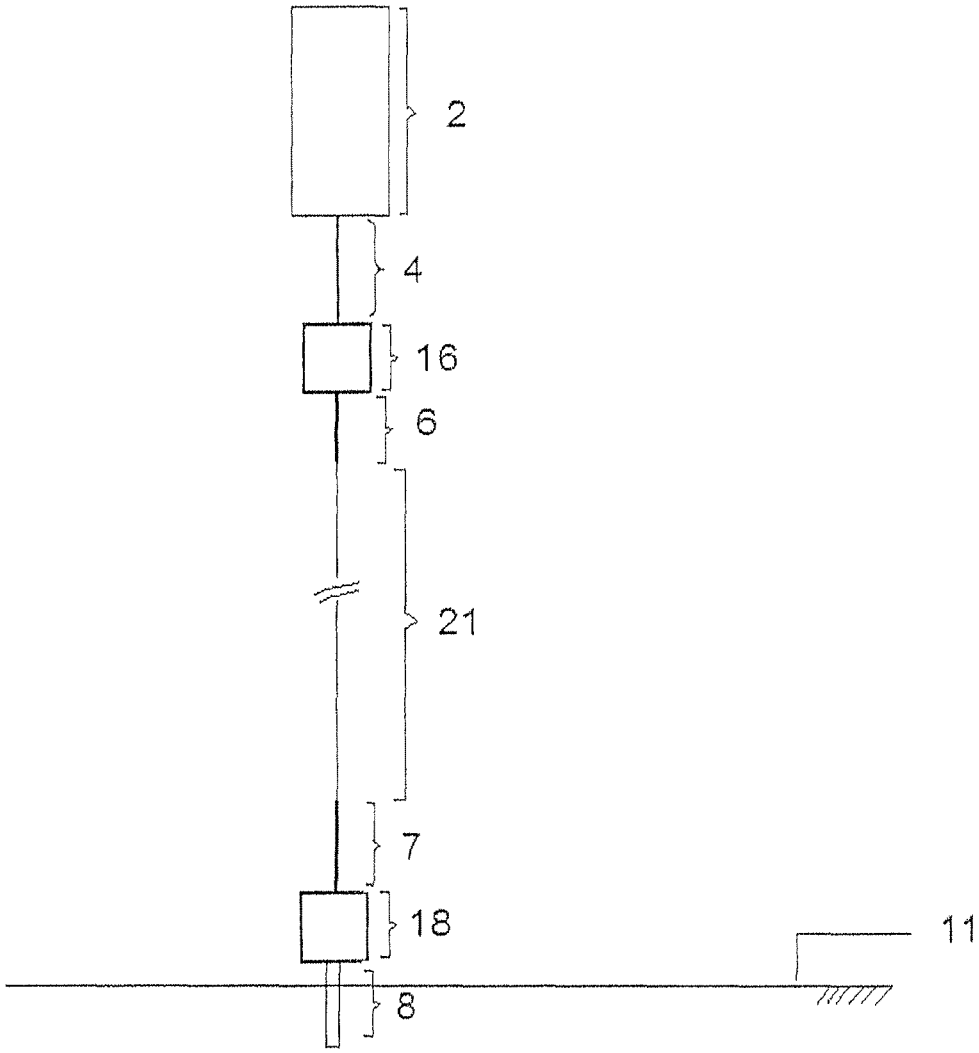
FIG. 7 illustrates the components of the improved FHRS.

FIG. 7 shows the components of the proposed new system which will be mentioned in the various stages of the process for installing the system. The spatial tubular structures of the Top Riser Assembly (TRA) (16) and Bottom Riser Assembly (BRA) (18) are represented in a simplified way.

Figure 10:
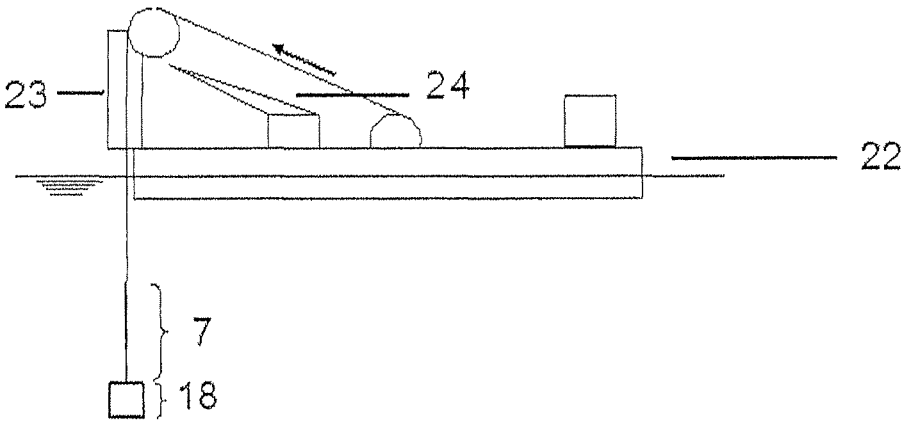
FIG. 10 illustrates the lowering of standard joints by the Reel Method.

The Reel Method is used to install the section corresponding to standard joints (21), where fatigue damage is significantly less than damage at the ends of riser (1). In these regions where upper (6) and lower (7) strengthening joints are located, special forged materials are used to effect the transition of forces. The Seven Oceans vessel illustrated in FIG. 8, which is of the PLSV (22) (Pipe Lay Support Vessel) type, equipped with dynamic positioning, is used for the initial activities in the proposed process. This vessel has a hinged tower (23) in the stern, which can rotate about an axis transverse to the vessel, so that pipes can be installed by the Reel Method. In this method the pipe is rolled onto a spool located on the vessel's deck at an onshore construction site. In offshore installation the pipe is unrolled and passes through the tower, where it regains its straight configuration, as shown in FIG. 10.

It is assumed that the PLSV vessel (22) (FIG. 8) has a crane (24) of sufficient capacity to lift some components of the system. However, when the improved freestanding hybrid riser (FHRS) is installed its weight will exceed the load capacity of the Seven Oceans' crane (24) and another vessel having a crane of greater capacity will be needed. BGL1 (25) (FIG. 13), the crane of which has a nominal capacity of 1000 tons, will be used to carry out the final activities of the proposed process.

Figure 8:
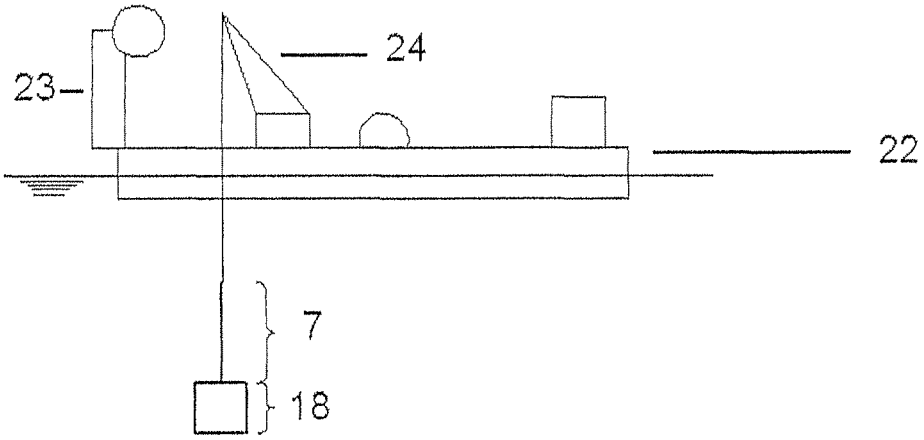
FIG. 8 illustrates lifting of the lower strengthening joint and BRA by the crane of the PLSV (Seven Oceans) and transfer to the tower.

FIG. 8 shows the lifting of lower strengthening joint (7) and BRA (18) by the PLSV vessel (22) Seven Oceans' crane (24) and transfer of the assembly to the tower (23). Lower strengthening joint (7) is for example connected to BRA (18) by means of a flange connection onshore and the assembly is transported to the place where the FHRS will be installed on the deck of the PLSV vessel (22) Seven Oceans.

Figure 9:
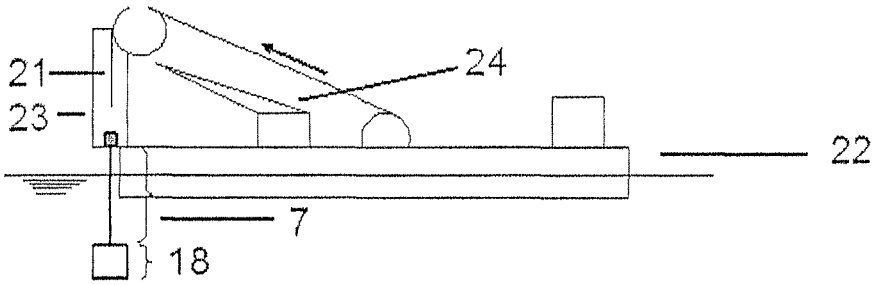
FIG. 9 illustrates welding the lower strengthening joint to the standard joint.

FIG. 8 shows lifting of the assembly by the PLSV vessel (22) Seven Oceans' crane (24). The assembly is then transferred to the tower where the first standard joint (21) is welded to lower strengthening joint (7) (FIG. 9). Subsequently standard joints (21) are lowered by the Reel Method, a length equivalent to standard joints (21) being unrolled (FIG. 10).

Figure 11:
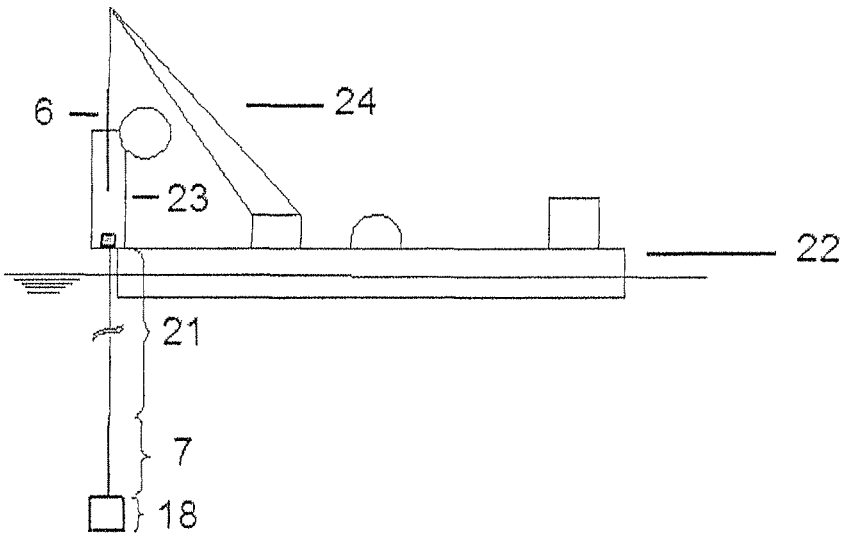
FIG. 11 illustrates handling of the upper strengthening joint for welding to the standard joint.
Figure 12:
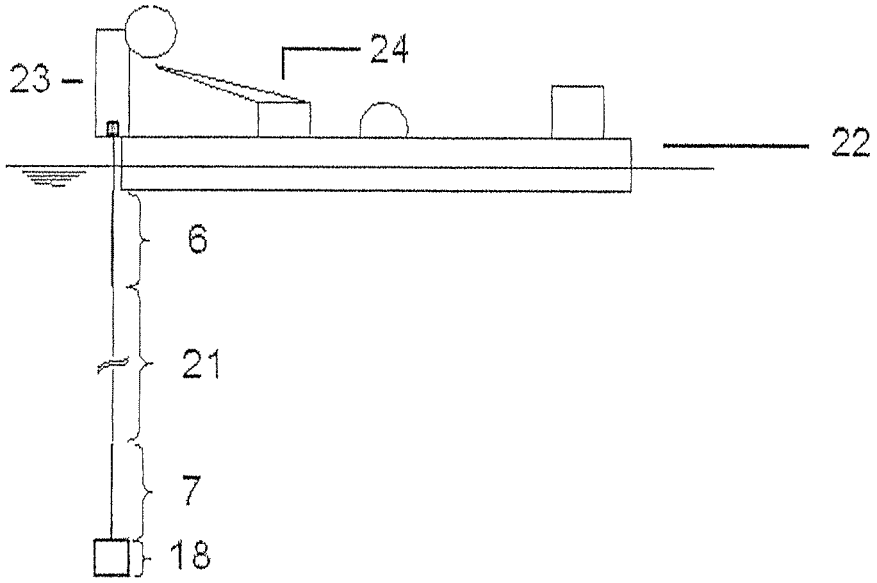
FIG. 12 illustrates preparation for delivery of the column to the crane and lay barge—BGL1.

The assembly comprising BRA (18), lower strengthening joint (7) and standard joints (21) is supported vertically by the bottom part of the PLSV vessel (22) Seven Oceans' tower (23) (FIG. 11). The crane (24) of the vessel lifts upper strengthening joint (6) from its deck and transfers it to the tower (23), where it is welded to the top end of standard joints (21) (FIG. 11). Subsequently the assembly is lowered by steel cable to a depth at which the transfer to BGL1 (25) can be made (FIG. 12).

Figure 13:
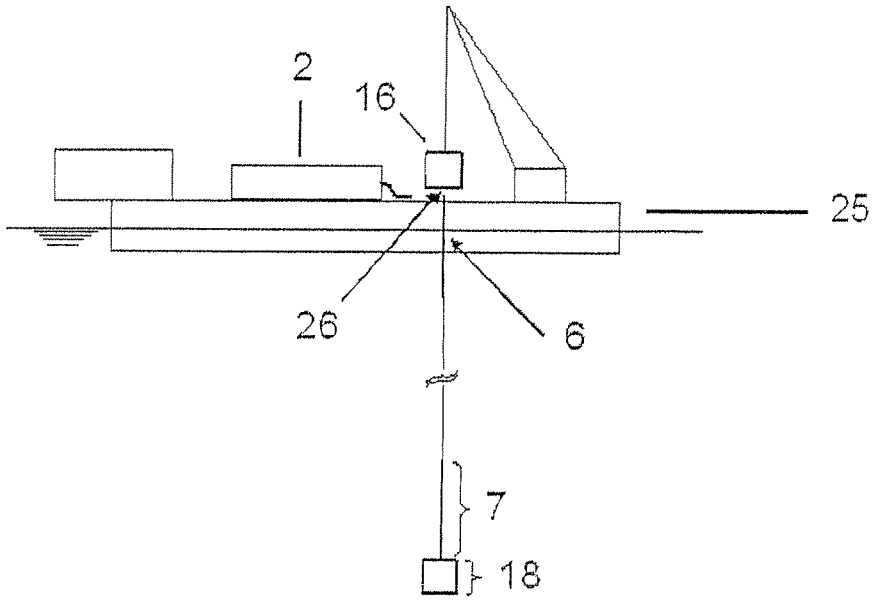
FIG. 13 illustrates the column supported alongside the BGL1 with handling of the top end component of the riser or Top Riser Assembly (TRA) and the flange connection to the upper strengthening joint.

FIG. 13 shows the assembly formed by upper strengthening joint (6), standard joints (21), lower strengthening joint (7) and BRA (18) supported alongside the hull of BGL1 (25). TRA (16) and floating tank (2) have been carried on the deck of BGL1 (25).

FIG. 13 also shows TRA (16) being lifted by the crane of BGL1 (25) to make the connection to upper strengthening joint (6) of the FHRS, by means of a flanged connection (26), for example.

Figure 14:
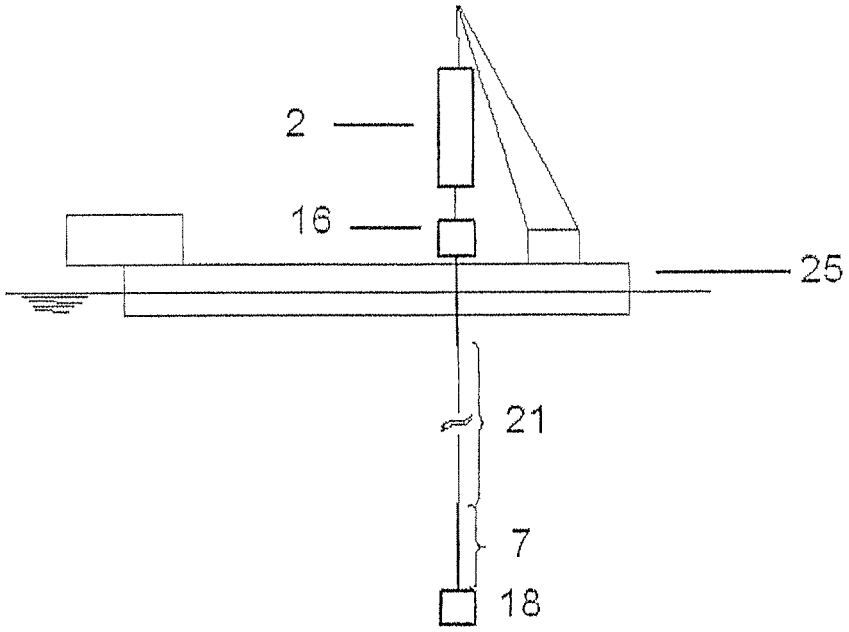
FIG. 14 illustrates handling of the floating tank and tie bar for connection to the TRA—situation 1.
Figure 15:
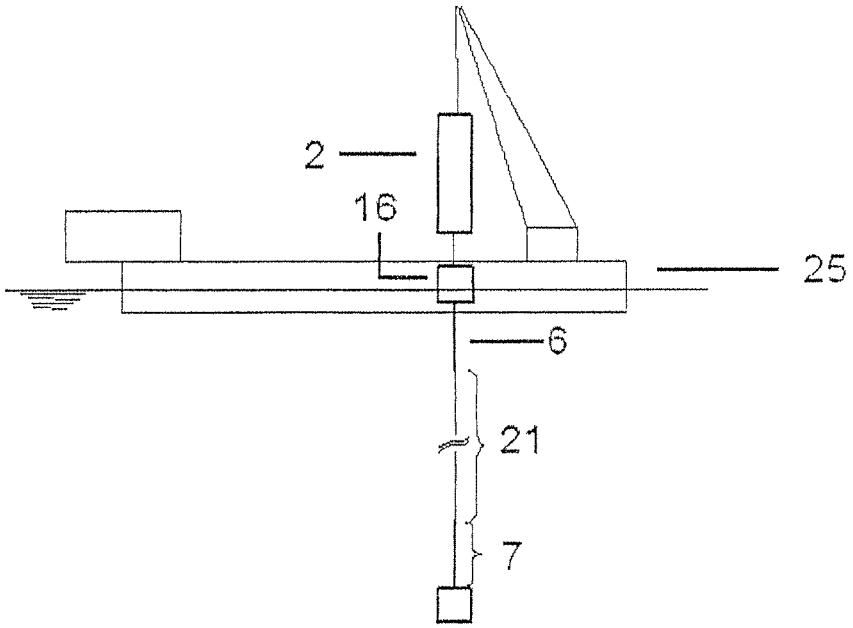
FIG. 15 illustrates handling of the floating tank and tie bar for connection to the TRA—situation 2.

Then the crane of BGL1 (25) lifts floating tank (2) and tie rod (4) to connect these to TRA (16) (FIG. 14), by for example a hydraulically acting connector. Alternatively, if the height of the top of TRA (16) is well above the deck of BGL1 (25) after TRA (16) has been connected to riser (1), the assembly will be lowered and will be suspended by TRA (16) secured alongside the hull (FIG. 15). In this position tie rod (4) is connected to TRA (16) with floating tank (2) being moved to a lower height, attenuating any problems of interference with the boom of the crane.

Figure 16:
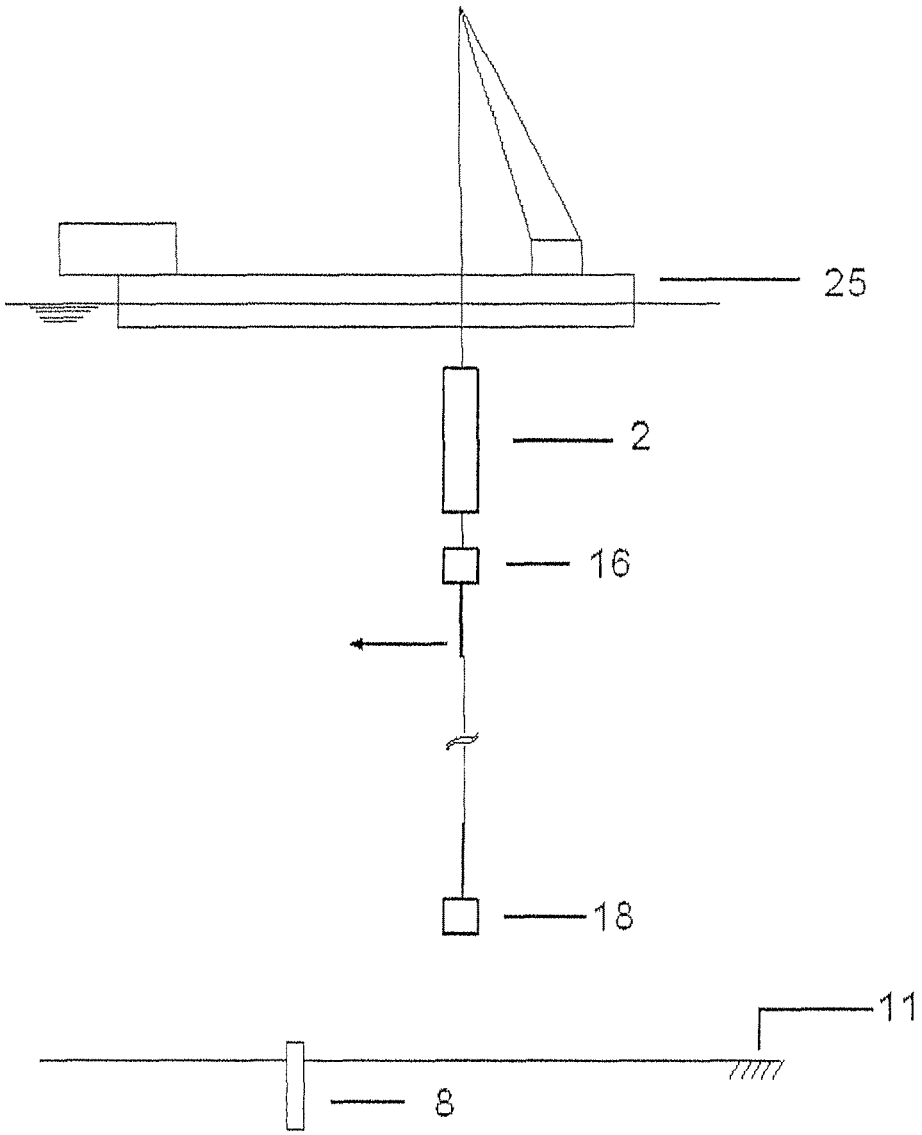
FIG. 16 illustrates lowering of the improved FHRS assembly.

The FHRS assembly is then lowered approximately 100 meters by the crane on BGL1 (25) to position BRA (18) a few tens of meters from its point of connection to the base (8) sea bed (11) (FIG. 16), and the assembly approaches along the vertical from base (8). During this stage the ballast and the pressure acting in the compartments of floating tank (2) are checked.

Figure 17:
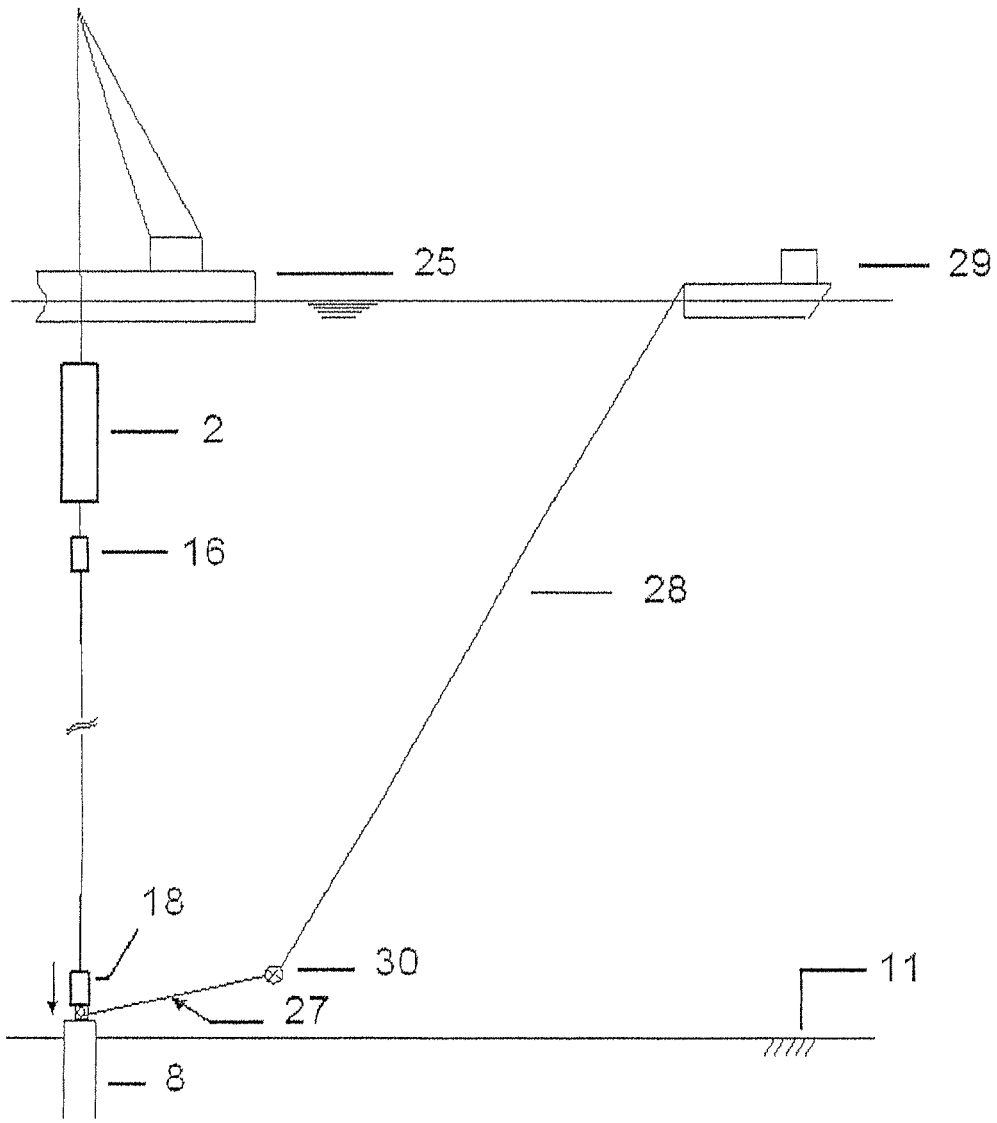
FIG. 17 illustrates connection of the improved FHRS assembly to the bottom.

As illustrated in FIG. 17, the improved FHRS is pulled down by BRA (18) by means of a polyester cable (29) which passes through a system of pulleys located on base (8) of the FHRS to connect the hydraulically activated connector located at the bottom of BRA (18) with base (8). Polyester cable (27) is connected to a steel cable (28) of a conventional anchor handling vessel (29). A counterweight (30) is used at the interface between polyester cable (27) and steel cable (28) to attenuate oscillation of the axial force on the cables due to movements of the vessel.

The proposed FHRS system provides new configurations at the interfaces at the top (3) and bottom (5) ends of the vertical section of riser (1) with flexible jumper (12) and base (8) causing a reduction in the static loads acting on these ends, and also the bending moment transmitted through lower strengthening joint (7) to the structure of BRA (18) and rigid jumper (9) is significantly attenuated by flexjoint (19) which acts as a filter for the bending forces originating from riser (1).

As for the method of installation, the Reel Method is proposed, this being much faster than the J-Lay method normally used. In addition to this, in the Reel Method all the welds (with the exception of those at the two ends of the vertical section) are made in a workshop onshore, in a controlled way, achieving good performance in relation to fatigue. In the J-Lay method there are various welds along the vertical section which are made in the field, and do not ensure as good quality as welds made onshore.

Combining the two vessels provides economic and technical advantages, because a vessel of the PLSV type (22) such as the Seven Oceans, for example, is contracted for a particular service and also used to carry out part of the installation of the improved FHRS. The other part of the installation is carried out by the crane and lay barge. The proposed installation can be carried out by combining the two vessels. There are in the world vessels which carry out the complete installation, but they are extremely expensive and less available than a vessel of smaller capacity like the PLSV vessel (22) Seven Oceans.

We claim:

1. A free standing hybrid riser system comprising:

a vertical section including an upper strengthening joint;

a buoyant unit;

a top riser assembly (TRA) below the buoyant unit and connected at a first connection point on the TRA to the upper strengthening joint, wherein a vertical axis extends through the first connection point;

the buoyant unit is connected to the TRA at a second connection point on the TRA wherein the second connection point is offset horizontally from the vertical axis; and a flexible jumper connected to the TRA at a third connection point on the TRA, wherein the third connection point is offset horizontally from the vertical axis;

wherein a first bending moment is applied about the first connection point on the TRA by the buoyant unit, and a second bending moment is applied about the first connection point to the TRA by the flexible jumper, wherein the first and second bending moments oppose each other.

2. The free standing hybrid riser system of claim 1 wherein the flexible jumper is connected to a surface floating vessel.

3. The free standing hybrid riser system of claim 1 wherein ft the horizontal offset between the first and second connection points is shorter than a the horizontal offset between first and third connection points offset.

4. The free standing hybrid riser system of claim 1 wherein the vertical axis is coaxial with the vertical section.

5. The free standing hybrid riser system of claim 1 wherein the horizontal offset between the first and third connection points is equal to the sum of the horizontal offset between the first and second connection points and a horizontal offset between the second and third connection points.

6. The free standing hybrid riser system of claim 1 further comprising:

a lower strengthening joint of the vertical section, wherein the lower strengthening joint is coaxial with an axis of the vertical section;

a rigid jumper and a base at a seabed;

a bottom riser assembly (BRA) interface between the rigid jumper and the vertical section, the BRA interface connects the lower strengthening joint to the base wherein a first vertical reaction force is applied to the lower strengthening joint due to the connection of the base to the BRA interface and the first vertical reaction force is an orthogonal distance from the vertical axis of the vertical section, and a second vertical reaction force is applied to the lower strengthening joint due to the connection between the BRA interface and the rigid jumper, wherein the second vertical reaction force is an orthogonal distance from the vertical axis of the vertical section upper strengthening joint axis, and wherein the first vertical reaction force applies a bending moment about the lower strengthening joint which opposes a bending moment applied by the second vertical reaction force about the lower strengthening joint.

7. A free standing hybrid riser system comprising:

a lower section connectable to a base on a sea bed and the lower section including an upper connection joint;

a top riser assembly (TRA) having a first connection point connectable to the upper connection joint;

a buoyant unit above the TRA and connected to the TRA at a second connection point on the TRA, wherein the second connection is offset in a horizontal direction from the first connection point; and a flexible jumper connected to the TRA at a third connection point on the TRA, wherein the third connection is offset in a horizontal direction from the first connection point;

wherein a first bending moment is applied about the first connection point on the TRA by the buoyant unit, and a second bending moment, opposite to the first, is applied about the first connection point to the TRA by the flexible jumper.

8. The free standing hybrid riser system of claim 7 wherein the flexible jumper is connected to a surface floating vessel.

9. The free standing hybrid riser system of claim 7 wherein a horizontal distance between the first and second connection points is shorter than a horizontal distance between first and third connection points offset.

10. The free standing hybrid riser system of claim 7 wherein the first connection point is coaxial with an axis of the lower section.

11. The free standing hybrid riser system of claim 7 wherein a horizontal distance between the first and third connection points is equal to the sum of the horizontal distances between the first and second connection points and the second and third connection points.

12. The free standing hybrid riser system of claim 7 further comprising:

a lower joint of the lower section;

a bottom riser assembly (BRA) which couples the lower joint of the lower section to the base, wherein a first vertical reaction force is applied to the lower section due to the connection of the base to the BRA and the first vertical reaction force is an first horizontal distance from a vertical axis of the lower section, and a second vertical reaction force is applied to the lower joint due to the connection between the BRA and a rigid jumper, wherein the second vertical reaction force is a second horizontal distance from the vertical axis of the lower section, and wherein the first vertical reaction force applies a bending moment about the lower joint opposing a bending moment applied by the second vertical reaction force about the lower joint.

* * * * *